US007488200B2

(12) United States Patent
Yamamoto et al.

(10) Patent No.: US 7,488,200 B2
(45) Date of Patent: Feb. 10, 2009

(54) CONNECTOR ASSEMBLY

(75) Inventors: Toshihiro Yamamoto, Tsu (JP); Hirohisa Tanaka, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/812,709

(22) Filed: Jun. 21, 2007

(65) Prior Publication Data

US 2007/0298641 A1 Dec. 27, 2007

(30) Foreign Application Priority Data

Jun. 22, 2006 (JP) ..... 2006-173035
Mar. 27, 2007 (JP) ..... 2007-081291

(51) Int. Cl.
*H01R 31/08* (2006.01)

(52) U.S. Cl. ..... 439/511; 439/65

(58) Field of Classification Search ..... 439/65, 439/507, 511, 512, 513
See application file for complete search history.

(56) References Cited

U.S. PATENT DOCUMENTS

| | | | | |
|---|---|---|---|---|
| 2,740,097 | A | 3/1956 | Edelman et al. | |
| 4,555,151 | A | 11/1985 | Neese et al. | |
| 4,969,825 | A * | 11/1990 | Enomoto et al. | 439/65 |
| 4,995,814 | A * | 2/1991 | Weidler | 439/61 |
| 5,195,897 | A | 3/1993 | Kent et al. | |
| 5,257,941 | A * | 11/1993 | Lwee et al. | 439/65 |
| 5,316,486 | A * | 5/1994 | Tanaka et al. | 439/62 |
| 5,387,111 | A | 2/1995 | DeSantis et al. | |
| 6,302,705 | B1 | 10/2001 | Yatskov et al. | |
| 6,428,349 | B1 * | 8/2002 | Dickson et al. | 439/513 |
| 7,232,324 | B2 * | 6/2007 | Oesterhaus | 439/268 |
| 2006/0034061 | A1 | 2/2006 | Grundy et al. | |

FOREIGN PATENT DOCUMENTS

| | | | |
|---|---|---|---|
| EP | 0 361 971 | A2 | 4/1990 |
| JP | 57-158969 | A | 9/1982 |
| JP | 04-012282 | U | 1/1992 |
| JP | 05-042626 | Y2 | 10/1993 |
| JP | 2000-100501 | A | 4/2000 |
| JP | 2000-100501 | A | 4/2000 |

OTHER PUBLICATIONS

European Search Report for the Application No. EP 07 01 1481, dated Oct. 16, 2007.
Notification of Reasons for Refusal for the Application No. 2006-173035 from Japan Patent Office, mailed Apr. 30, 2008.

* cited by examiner

*Primary Examiner*—Thanh-Tam T Le
(74) *Attorney, Agent, or Firm*—Cheng Law Group PLLC

(57) ABSTRACT

This connector assembly comprises a pair of receptacles 1, and an attachment member 2. Each receptacle comprises a housing 10, and substrate terminals 11. The attachment member 2 comprises a pair of holders 20, and connection members 21. The connection members comprise first connection members 21*a* and second connection members 21*b*. Each of the first and second connection members have, respectively, a link section 200, 210 disposed between the pair of holders, and connection terminals 201, 211 formed at both ends of the link section. The first connection members connect between the substrate terminals arranged on a side of each housing which is near the opposite housing, and the second connection members connect between the substrate terminals arranged on a side far from the opposite housing. The link section of each first connection member is disposed nearer to the printed circuit boards than the link section each second connection member.

6 Claims, 13 Drawing Sheets

CONNECTOR ASSEMBLY

TECHNICAL FIELD

The present invention relates to a connector assembly for electrical connection between two printed circuit boards arranged side by side.

BACKGROUND ART

Japanese Non-examined Patent Publication No. 2000-100501 discloses a connector assembly for electrical connection between two printed circuit boards arranged side by side. As shown in FIG. 16, this connector assembly comprises a socket 500 mounted on one printed circuit board P1 and a header 600 mounted on the other printed circuit board P2. The socket 500 has a connection concave portion 501, and a plurality of terminals 502 connected to a circuit on the printed circuit board P1 are arranged inside the connection concave portion 501. The header 600 has an insertion member 601 to be inserted into the connection concave portion 501, and a plurality of terminals 602 are arranged on the insertion member 601. When the insertion member 601 is inserted into the connection concave portion 501, each of the terminals 602 of the header 600 comes in contact with each of the terminals 502 of the socket 500, whereby both printed circuit boards are electrically connected to each other.

However, in the above connection assembly, in order to connect the socket 500 and the header 600 with each other, it is necessary to insert the insertion member 601 of the header 600 into the socket 500 while moving them closer to each other. Therefore, if the printed circuit boards P1, P2 are fixed, it was not possible to connect the socket 500 and the header 600 to each other.

DISCLOSURE OF THE INVENTION

In view of the above problem, the object of the present invention is to provide a connector assembly capable of connecting easily between two printed circuit boards arranged side by side even when positions of the two printed circuit boards are fixed.

A connector assembly of the present invention is a connector assembly for electrical connection between two printed circuit boards arranged side by side, and it comprises a pair of receptacles configured to be mounted on each printed circuit board, respectively, and an attachment member connected to the pair of receptacles so as to electrically connect between the pair of receptacles. Each of the receptacles comprises a housing made from an insulating material and configured to be fixed on one of the printed circuit boards, and a plurality of substrate terminals made from a conductive material and configured to be electrically connected to the printed circuit board, and the plurality of substrate terminals are arranged on both sides of the housing in a direction perpendicular to an arranging direction of the two printed circuit boards. The attachment member comprises a pair of holders coupled to the pair of receptacles, and a plurality of connection members which connect between the pair of holders electrically. The plurality of connection members comprise first connection members and second connection members, and each of the first connection members and each of the second connection members have, respectively, a link section disposed between the pair of holders, and connection terminals formed at both ends of the link section and coming into contact with the substrate terminals of the receptacles when the pair of holders are coupled to the pair of receptacles. The first connection members connect between the substrate terminals arranged on a side of each housing which is near the opposite housing out of the substrate terminals arranged on both sides of each housing, and the second connection members connect between the substrate terminals arranged on a side of each housing which is far from the opposite housing out of the substrate terminals arranged on both sides of each housing. The link section of each of the first connection members is disposed nearer to the printed circuit boards than the link section of each of the second connection members in a thickness direction of the printed circuit boards.

In the connector assembly of the present invention, because two printed circuit boards can be electrically connected to each other by coupling the pair of holders of the attachment member to the housings of the pair of receptacles in the thickness direction of the printed circuit boards, it is possible to easily connect between two printed circuit boards arranged side by side even when the positions of the two printed circuit boards are fixed. Furthermore, because the link section of the first connection member is disposed nearer to the printed circuit boards than the link section of the second connection member in a thickness direction of the printed circuit boards, the link section of the first connection member and the link section of the second connection member do not interfere with each other, and therefore it is possible to arrange many connection members.

Preferably, the link section of each of the first connection members and the link section of each of the second connection members have, respectively, a spring section which is curved or bent in the thickness direction of the printed circuit boards and has elastic deformability for allowing change of a distance between the connection terminals. In this case, displacement of the two printed circuit boards or the receptacles in the arranging direction of the two printed circuit boards can be absorbed by the spring section.

Preferably, the attachment member further comprises a spacer which is made from an insulating material and separates the link section of each of the first connection members and the link section of each of the second connection members from each other. In this case, it is possible to ensure insulation between the link section of the first connection member and the link section of the second connection member.

Preferably, the spacer has injection grooves in which the link sections of either the first connection members or the second connection members are pressed and fixed, and slide grooves which are formed in a surface of the spacer opposite to the injection grooves and hold slidably the link sections of the other of the first connection members and the second connection members. In this case, the spacer does not interfere with elastic deformation of the connection members while ensuring insulation between the link section of the first connection member and the link section of the second connection member.

Preferably, each of the holders has first holding grooves into which the connection terminals of the first connection members are pressed, and second holding grooves into which the connection terminals of the second connection members are pressed, and the first holding grooves are opened in a common direction between the pair of holders, and the second holding grooves are opened in a direction in which the holders are removed from the receptacles. In this case, it is possible to easily assemble the attachment member by attaching the first and second connection members to the holders in the thickness direction of the printed circuit boards.

Preferably, the connector assembly further has a cover which is made from an insulating material and is fixed to the pair of receptacles or the pair of holders so as to cover the connection members. In this case, it is prevented that a user carelessly touches the connection members or environmental dusts adhere to the connection members, and therefore it is possible to increase insulation properties of the connection members.

Preferably, the cover has a separator which is integrally molded with the cover and is disposed between adjacent connection members to separate therebetween. In this case, it is possible to prevent adjacent connection members from coming into contact with each other. Furthermore, by integrally molding the separator with the cover, it is possible to reduce the number of the parts.

Preferably, the cover has first engagement parts and each of the holders has a second engagement part, and the cover is fixed to each of the holders by engaging the first engagement parts with the second engagement part of each of the holders. In this case, when the cover is detached from the receptacles, each holder connected to the cover is also detached from the receptacles. So, it is easy to detach the attachment member from the receptacles. Furthermore, because it is possible to detach the attachment member from the receptacles while maintaining the positional relation between the holders, the connection members can be prevented from being strained, and the deformation of the connection members can be prevented.

Preferably, each of the first engagement parts is an opening formed in a side wall of the cover, and the second engagement part is a protrusion formed on a side surface of each of the holders, and the protrusion is configured to be disposed in the opening, and the opening has a width larger than a width of the protrusion. In this case, even if the positions of the receptacles are misaligned in the arranging direction of the two printed circuit boards, it is possible to comfortably attach the cover to the pair of holders because the width of the opening is larger than that of the protrusion. As a result, it is prevented that excessive force is added to the holders from the cover. Furthermore, it is prevented that attaching the cover deteriorates a connected state between the receptacles and the holders.

Preferably, the cover has an elastic deformation part capable of deforming elastically to allow displacement of the two printed circuit boards. In this case, even if the positions of the receptacles are misaligned, especially, in the direction perpendicular to the arranging direction of the two printed circuit boards, it is possible to comfortably attach the cover to the pair of receptacles or the pair of holders by elastic deformation of the elastic deformation part. As a result, it is prevented that excessive force is added to the holders or the receptacles by the cover. Furthermore, it is prevented that attachment of the cover deteriorates a connection state between the receptacles and the holders.

BEST MODE FOR CARRYING OUT THE INVENTION

Figure 1C:
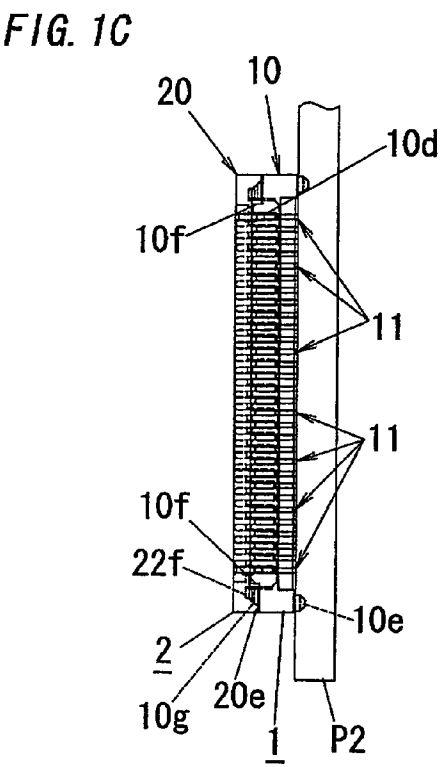
FIG. 1C is a side view of the connector assembly of FIG. 1A.

Hereinafter, the present invention will be described in more detail with reference to the accompanying drawings.

First Embodiment

FIGS. 1A, 1B, 1C, and 2 show a connector assembly in accordance with a first embodiment of the present invention. The connector assembly is a connector assembly for electrical connection between two printed circuit boards P1 and P2 arranged side by side, and it comprises a pair of receptacles 1 configured to be mounted on each printed circuit board, respectively, and an attachment member 2 connected to the pair of receptacles 1 so as to electrically connect between the pair of receptacles 1.

Each receptacle 1 comprises a housing 10 made from an insulating material e.g. a synthetic resin and fixed on one of the printed circuit boards, and a plurality of substrate terminals 11 made from a conductive material and electrically connected to an electrical circuit (not shown) on the printed circuit board.

The housing 10 has a rectangular parallelepiped shape, and has a groove-like connection concave portion 10*a* along a longitudinal direction thereof. The housing 10 is disposed on one of the printed circuit board so that the longitudinal direction thereof becomes perpendicular to an arranging direction of the two printed circuit boards P1 and P2. The housing 10 has side walls 10*b*, 10*c* on both sides of the connection concave portion 10*a* along its longitudinal direction, and a plurality of grooves 10*d*, in which the substrate terminals 11 are disposed, are formed in the side walls 10*b* and 10*c* from the inside thereof to the outside. The housing 10 has positioning protrusions 10*e* on the undersurface thereof, and the position of the housing 10 with respect to the printed circuit board is decided by inserting the positioning protrusions 10*e* into holes formed in the printed circuit board.

Figure 1B:
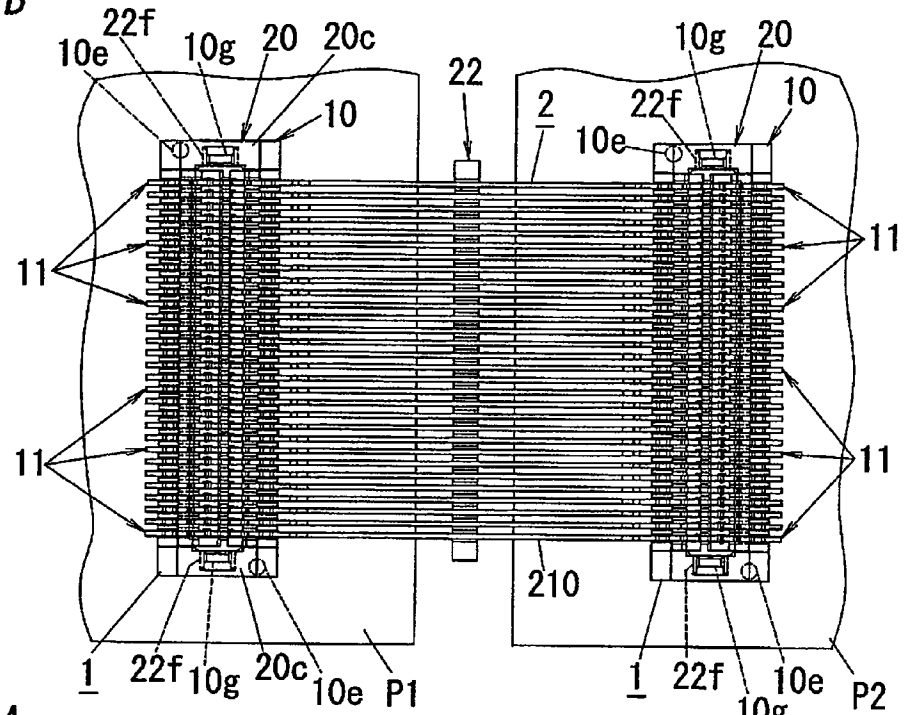
FIG. 1B is a plan view of the connector assembly of FIG. 1A.
Figure 1A:
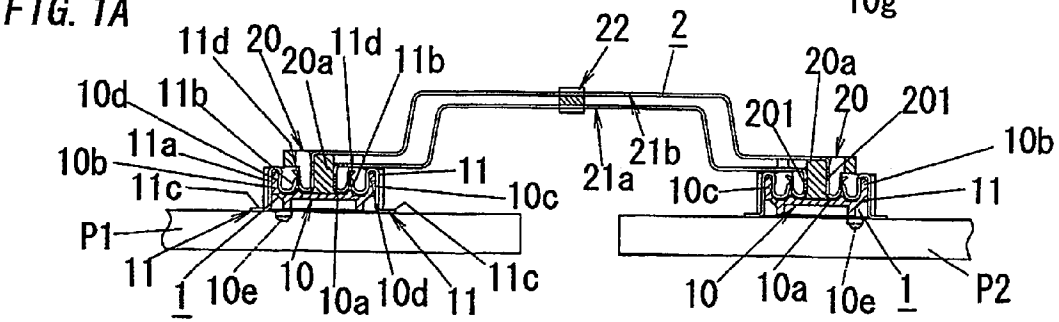
FIG. 1A is a cross-sectional view of a connector assembly in accordance with a first embodiment of the present invention.

Each substrate terminal 11 is formed from a metal plate by punching process and bending process, and it has a held section 11*a* which has an inverted U-shaped configuration and which is inserted into one of the grooves 10*d*, a contact 11*b* which has elasticity and is extended from an end on the connection concave portion 10*a* side of the held section 11*a* and runs upward in the connection concave portion 10*a*, and a terminal section 11*c* which is extended from an outside end of the held section 11*a* to the outside of the housing 10 and is soldered to the electrical circuit on the printed circuit board. The substrate terminals 11 are arranged in the grooves 10*d* of the side walls 10*b* and 10*c* of the housing 10 so that they face each other. As a result, as shown in FIG. 1B, the plurality of substrate terminals 11 are arranged on both sides of the housing 10 in the direction perpendicular to the arranging direction of the two printed circuit boards P1, P2.

Figure 3:
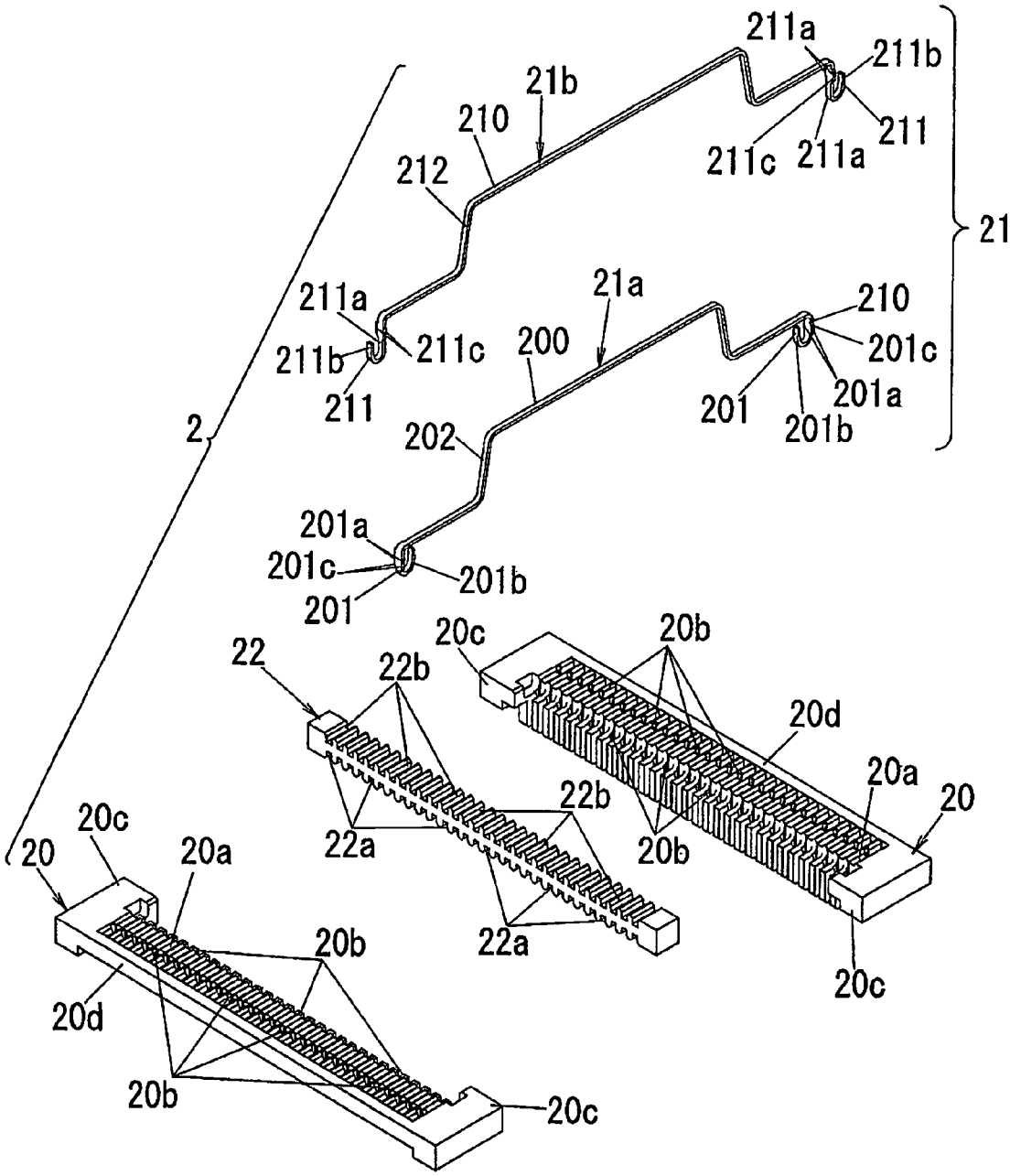
FIG. 3 is an exploded perspective view of an attachment member of the connector assembly of FIG. 1A.
Figure 4:
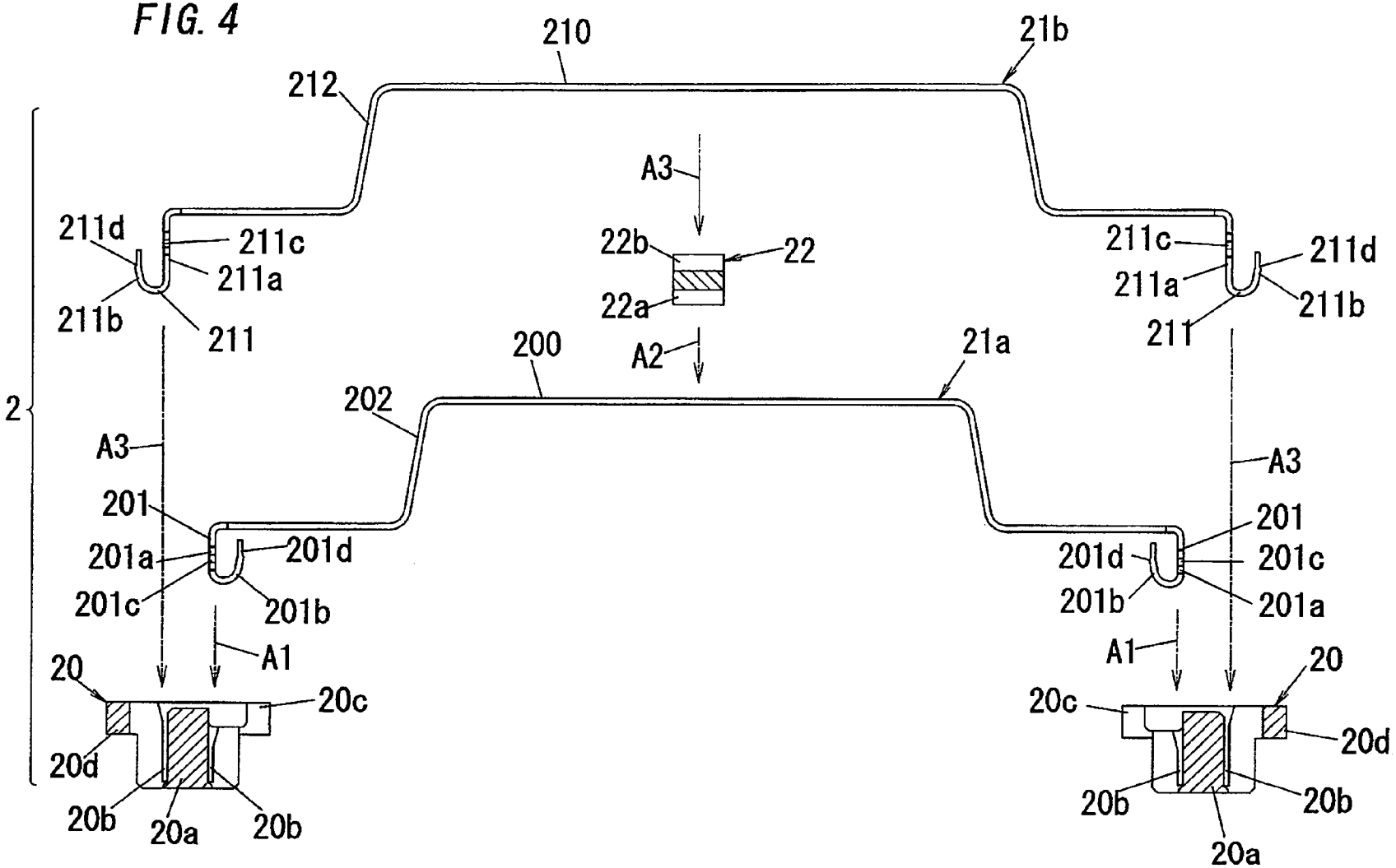
FIG. 4 is an exploded cross view of the attachment member of the connector assembly of FIG. 1A.

As shown in FIGS. 3 and 4, the attachment member 2 comprises a pair of holders 20 which can be coupled to the pair of receptacles 1 and a plurality of connection members 21 which are made from a conductive material and connect between the pair of holders 20 electrically.

Each holder 20 has a connection convex portion 20*a* which can be inserted into the connection concave portion 10*a* of the receptacle 1. A plurality of holding grooves 20*b*, which are for holding after-mentioned connection terminals 201, 211 of the connection members 21, are formed on both sides of the connection convex portion 20*a* in the longitudinal direction thereof. Furthermore, on both longitudinal ends of the connection convex portion 20*a*, grip portions 20*c* projecting in the width direction (a direction perpendicular to the longitudinal direction) are formed. A user can grip the grip portions 20*c* to attach or detach the holder 20 to or from the receptacle 1. The grip portions 20*c* are connected to each other by a beam 20*d*. By the beam 20*d*, the mechanical strength of the holder 20 can be increased, and after-mentioned connection terminals 202 can be protected.

The connection members 21 comprise a plurality of first connection members 21*a* and a plurality of second connection members 21*b*. The first connection members 21*a* are for connecting between the substrate terminals 11 arranged on a side of each housing 10 which is near the opposite housing 10 out of the substrate terminals 11 arranged on both sides of the housing 10, and the second connection members 21*b* are for connecting between the substrate terminals 11 arranged on a side of each housing 10 which is far from the opposite housing 10 out of the substrate terminals 11 arranged on both sides of the housing 10. Each first connection member 21*a* has a link section 200 which is disposed between the pair of holders 20 and connection terminals 201 formed at both ends of the link section 200. Each of the connection terminals 201 is held by the holder 20 and comes into contact with one of the substrate terminals 11 when the pair of holders 20 is coupled to the pair of receptacles 1. In a similar way, each second connection member 21*b* has a link section 210 which is disposed between the pair of holders 20 and connection terminals 211 formed at both ends of the link section 210. Each of the connection terminals 211 is also held by the holder 20 and comes into contact with one of the substrate terminals 11 when the pair of holders 20 are coupled to the pair of receptacles 1.

Each connection terminal 201 of the first connection member 21*a* has a generally U-shaped configuration, and it comprises a held section 201*a*, which is extended downward (in FIG. 4) from an end of the link section 200 and is pressed into the holding groove 20*b* of the holder 20, and a contact 201*b*, which has elasticity and is extended from an end of the held section 201*a* toward the link section 200 side (namely, to the inside of the first connection member 21*a*) and runs upward (in FIG. 4). Protrusions 201*c* are formed on both sides of the held part 201*a*, and they are engaged into the inner surface of the holding groove 20*b* when the held section 201*a* is pressed into the holding groove 20*b*, whereby the connection terminal 201 can be prevented from dropping from the holding groove 20*b*.

Each connection terminal 211 of the second connection member 21*b* has a generally U-shaped configuration, and it comprises a held section 211*a*, which is extended downward (in FIG. 4) from an end of the link section 200 and is pressed into the holding groove 20*b* of the holder 20, and a contact 211*b* which has elasticity and is extended from an end of the held section 211*a* to the opposite side of the link section 200 (namely, to the outside of the first connection member 21*b*) and runs upward (in FIG. 4). Protrusions 211*c* are formed on both sides of the held part 211*a*, and they are engaged into the inner surface of the holding groove 20*b* when the held section 201*a* is pressed into the holding groove 20*b*, whereby the connection terminal 211 can be prevented from dropping from the holding groove 20*b*.

As shown in FIG. 4, a midsection of the link section 200 of the first connection member 21*a* is bent into an inverted U-shaped configuration in the thickness direction of the printed circuit boards P1, P2, whereby a spring section 202 for allowing change of a distance between the connection terminals 201 is formed. In a similar way, a midsection of the link section 210 of the second connection member 21*b* is bent into an inverted U-shaped configuration in the thickness direction of the printed circuit boards P1, P2, whereby a spring section 212 for allowing change of a distance between the connection terminals 211 is formed. That is, by elastic deformation of the spring sections 202 and 212, misalignment between the printed circuit boards P1, P2 and/or between the pair of receptacles 1 in the arranging direction of the two printed circuit boards can be absorbed.

Figure 2:
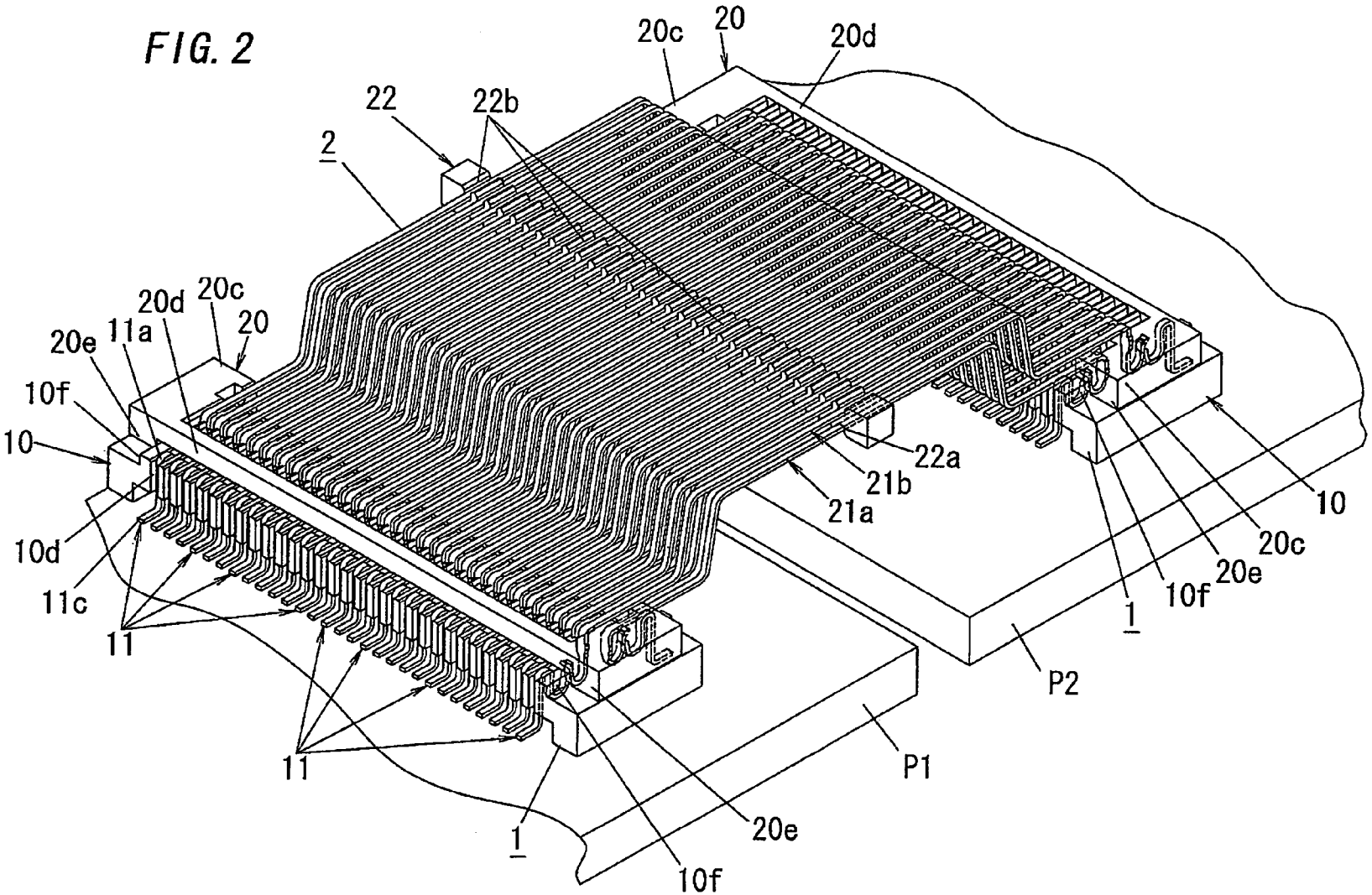
FIG. 2 is a perspective view of the connector assembly of FIG. 1A.

When the first connection members 21*a* and the second connection members 21*b* are connected to the holders 20, the link section 200 of each of the first connection members 21*a* is disposed nearer to the printed circuit boards P1, P2 than the link section 210 of each of the second connection members 21*b* in the thickness direction of the printed circuit boards, as shown in FIG. 2. In other words, the link section 200 of each first connection member 21*a* is disposed below the link section 210 of each second connection member 21*b*. By disposing the link section 200 of each first connection member 21*a* below the link section 210 of each second connection member 21*b*, the first connection member 21*a* and the second connection member 21*b* do not interfere with each other, whereby it is possible to arrange many connection members 21 along the longitudinal direction of the holder 20.

In this embodiment, the attachment member further comprises a spacer 22 which is made from an insulating material and is disposed between the link section 200 of each of the first connection members 21*a* and the link section 210 of each of the second connection members 21*b* to separate between them (in other words, to separate the link section 200 of each of the first connection members 21*a* and the link section 210 of each of the second connection members 21*b* from each other). By providing the spacer 22, it is possible to ensure electric insulation between the link section 200 of each of the first connection members 21*a* and the link section 210 of each of the second connection members 21*b*. As shown in FIG. 4, the spacer 22 has injection grooves 22*a* in which the link sections 200 of the first connection members 21*a* are respectively pressed and fixed in the surface on the printed circuit boards P1 and P2 side, and the spacer 22 has slide grooves 22*b* which hold slidably the link sections 210 of the second connection members 21*b* in a surface opposite to the surface in which the injection grooves 22*a* were formed. That is, the width of each injection groove 22*a* is roughly equal to the width of the link section 200 of the first connection member 21*a*, and the width of each slide groove 22*b* is slightly larger than the width of the link section 210 of the second connection member 21*b*. By forming the slide grooves 22*b* in the spacer 22 in addition to the injection grooves 22*a*, it becomes possible for the link sections 210 of the second connection members 21*b* to move in the vertical and the horizontal directions in FIG. 4 while ensuring the electrical isolation between the link sections 200 and the link sections 210. Therefore, the spacer does not interfere with elastic deformation of the connection members 21.

The attachment member 2 constituted as above is connected to the pair of receptacles 1 by inserting the connection convex portion 20*a* of each holder 20 into the connection concave portion 10*a* of each housing 10. At this time, the contacts 11*b* of the substrate terminals 11 of the receptacles 1 and the contacts 201*b* and 211*b* of the connection terminals 201 and 211 of the attachment member 2 come into contact with each other while elastically deforming. Each of the contacts 201*b* and 211*b* of the attachment member 2 has a concave portion 201*d*, 211*d*, respectively, in the tip thereof (see FIG. 4), and on the other hand, each of the contacts 11*b* of the receptacles 1 has a protrusion 11*d* (see FIG. 1A) in the tip thereof, and each protrusion 11*d* drops in each concave portion 201*d* or 211*d* when each contact 201*b* and 211*b* and each contact 11*b* are connected to each other, whereby the user can get a click feeling. Furthermore, because the protrusions 11*d* and the concave portions 201*d*, 211*d* are engaged with each other, it is prevented that the connection convex portion 20*a* drops from the connection concave portion 10*a*.

As shown in FIG. 2, convex steps 20*e* are formed on the undersurface of each of the grip portions 20*c* of each holder 20, and concave steps 10*f* are formed on the upper surface of the housing 10 of each receptacle 1 at the longitudinal both ends thereof, and the convex steps 20*e* are engaged with the concave steps 10*f* to prevent misalignment of the holder 20 with respect to the housing 10 in the longitudinal direction of the housing 10. Furthermore, as shown in FIG. 1B, positioning concave portion 20*f* is formed in the undersurface of each of the grip portions 20*c*, and positioning protrusions 10*g* are formed on the upper surface of each of the housings 10 in the longitudinal both ends thereof, and the position of the holder 20 is decided with respect to the housing 10 by inserting the positioning protrusions 10*g* into the positioning concave portions 20*f*.

In the connector assembly constituted as above, it is possible to easily connect two printed circuit boards P1 and P2 arranged side by side to each other by attaching the attachment member 2 in which the pair of holders 20 are connected to each other by the connection members 21 to the pair of receptacles 1 along the thickness direction of the printed circuit boards, even when the two printed circuit boards P1 and P2 are arranged on e.g. a case (not shown) side by side and are fixed thereto. Furthermore, in this connector assembly, it is possible to absorb misalignment between the printed circuit boards P1, P2 or between the pair of receptacles 1 by the elastic deformation of the spring sections 202 and 212 of the link sections 200 and 210 of the attachment member 2.

In addition, in this embodiment, as shown in FIG. 4, the holding grooves 20*b* (hereinafter, called first holding grooves) of the holder 20 into which the connection terminals 201 of the first connection members 21*a* are pressed and the holding grooves 20*b* (hereinafter, called second holding grooves) into which the connection terminals 211 of the second connection members 21*b* are pressed are both opened in a direction in which the holders 20 are removed from the receptacles 1 (that is, in the upward direction in FIG. 4). Therefore, it is possible to assemble the attachment member 2 easily by attaching the first connection members 21*a* to the holders 20 in the direction shown by an arrow A1, and then attaching the spacer 22 to the first connection members 21*a* in the direction shown by an arrow A2, and then attaching the second connection members 21*b* to the spacer 22 and the holders 20 in the direction shown by an arrow A3. Or, the first holding grooves 20*b* of the holder 20 into which the connection terminals 201 of the first connection members 21*a* are pressed may be opened in a direction in which the holders 20 are attached to the receptacles 1 (that is, in a downward direction in FIG. 4), and the first connection members 21*a* may be attached to the holders 20 from below. That is, in a case where the first holding grooves are opened in a common direction between the pair of holders 20 and the second holding grooves are opened in a direction in which the holders 20 are removed from the receptacles 1 in both holders 20, it is possible to assemble the attachment member 2 easily by attaching the first and second connection members 21*a* and 21*b* to the holders 20 in the thickness direction of the printed circuit boards P1 and P2.

As to the spacer 22, the spacer 22 may be configured so that the second connection members 21*b* are pressed in the injection grooves 22*a* and the first connection members 21*a* are disposed in the slid grooves 22*b*.

In addition, the connection convex portion 20*a* may be formed in the housing 10, and the connection concave portion 10*a* may be formed in the holder 20. The connection concave portion 10*a* may be penetrated in the vertical direction.

In addition, the spring section 202 of each first connection member 21*a* and the spring section 212 of each second connection member 21*b*may be curved in the thickness direction of the printed circuit boards.

Second Embodiment

Figure 5:
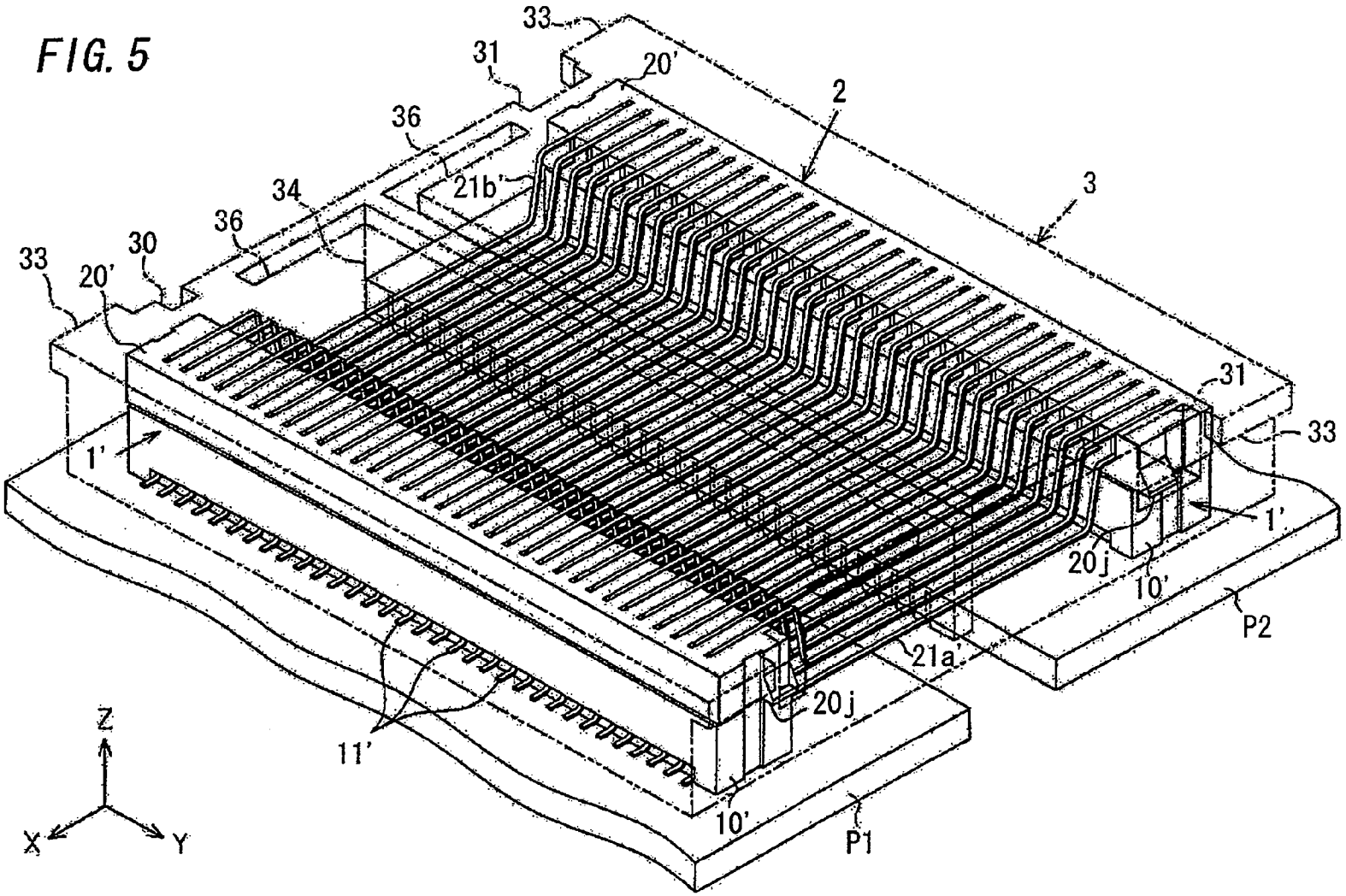
FIG. 5 is a perspective view of a connector assembly in accordance with a second embodiment of the present invention.
Figure 6:
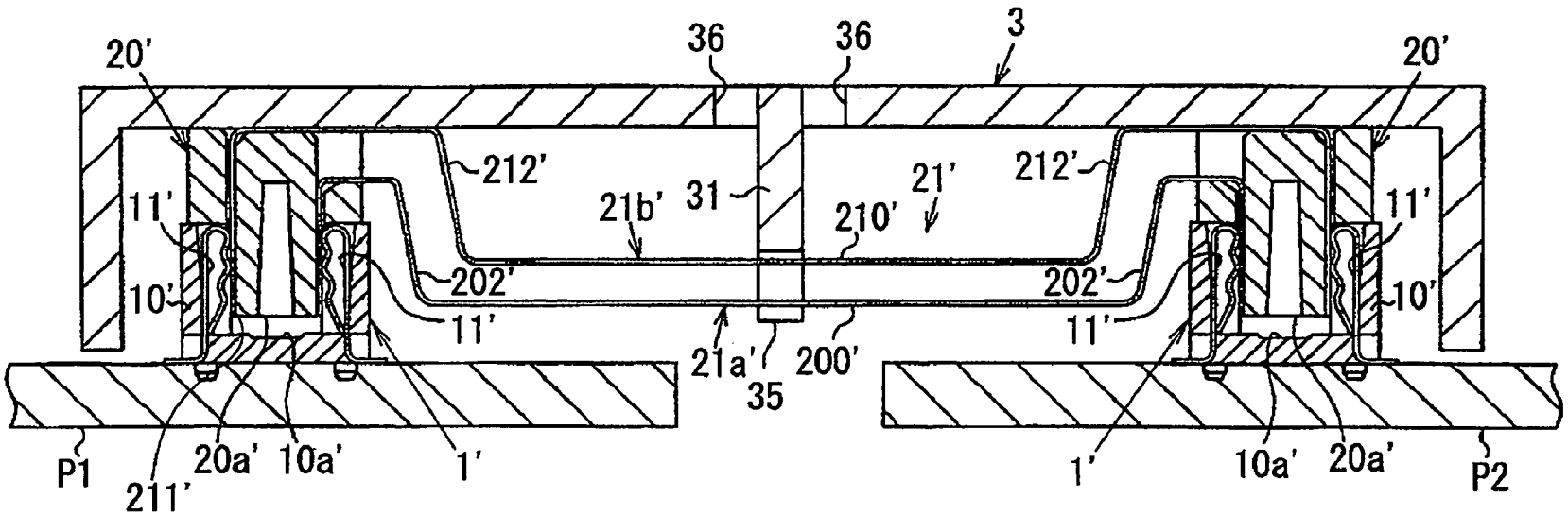
FIG. 6 is a cross-sectional view of the connector assembly of FIG. 5.

FIGS. 5 and 6 show a connector assembly in accordance with a second embodiment of the present invention. The basic composition of this embodiment is identical to the first embodiment, so similar parts to the first embodiment are identified by the same reference character and no duplicate explanation is made here.

The connector assembly is a connector assembly for electrical connection between two printed circuit boards P1 and P2 arranged side by side, and it comprises a pair of receptacles 1' configured to be mounted on each printed circuit board, respectively, and an attachment member 2'connected to the pair of receptacles 1' so as to electrically connect between the pair of receptacles 1', and a cover 3 made from an insulating material and fixed to a pair of holders 20' of the attachment member 2'.

Each receptacle 1' comprises a housing 10' made from an insulating material e.g. a synthetic resin and fixed on one of the printed circuit boards, and a plurality of substrate terminals 11' made from a conductive material and electrically connected to an electrical circuit (not shown) on the printed circuit board.

Figure 7:
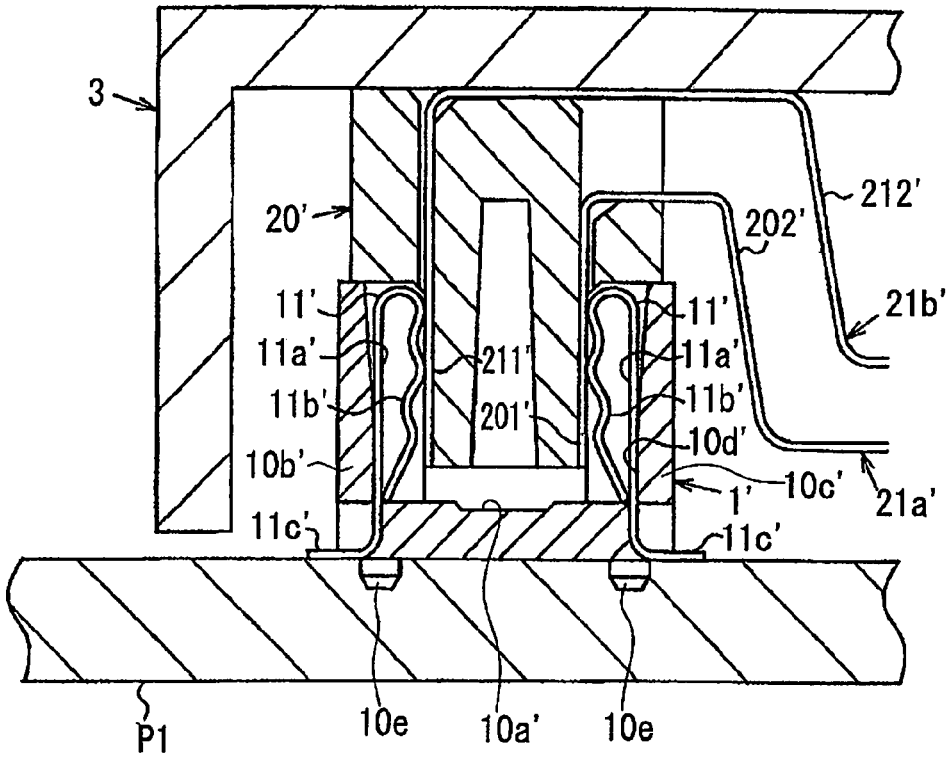
FIG. 7 is a cross-sectional view of a substantial part of the connector assembly of FIG. 5.

The housing 10' has a rectangular parallelepiped shape, and has a groove-like connection concave portion 10*a'* (see FIG. 7) along a longitudinal direction thereof. The housing 10 is disposed on one of the printed circuit boards so that the longitudinal direction thereof becomes perpendicular to an arranging direction of the two printed circuit boards P1 and P2. As shown in FIG. 7, the housing 10 has side walls 10*b*' and 10*c*'on both sides of the connection concave portion 10*a*' along its longitudinal direction, and a plurality of grooves 10*d*', in which the substrate terminals 11' are disposed, are formed inside the side walls 10*b*', 10*c*'.

Each substrate terminal 11' has a linear held section 11*a*' held by one of the grooves 10*d*', a contact 11*b*' which has elasticity and is extended from a top end of the held section 11*a*' and runs downward in the connection concave portion 10*a*', and a terminal section 11*c*' which is extended from an outside end of the held section 11*a*' to the outside of the housing 10' and which is soldered to the electrical circuit on the printed circuit board. The substrate terminals 11' are arranged in the grooves 10*d*' of the side walls 10*b*' and 10*c*' of the housing 10' so that they face each other. As a result, the plurality of substrate terminals 11' are arranged on both sides of the housing 10' in the direction perpendicular to the arranging direction of the two printed circuit boards P1, P2.

As shown in FIG. 6, the attachment member 2' comprises a pair of holders 20' which can be coupled to the pair of receptacles 1' and a plurality of connection members 21' which are made from a conductive material and connect between the pair of holders 20' electrically.

Figure 8:
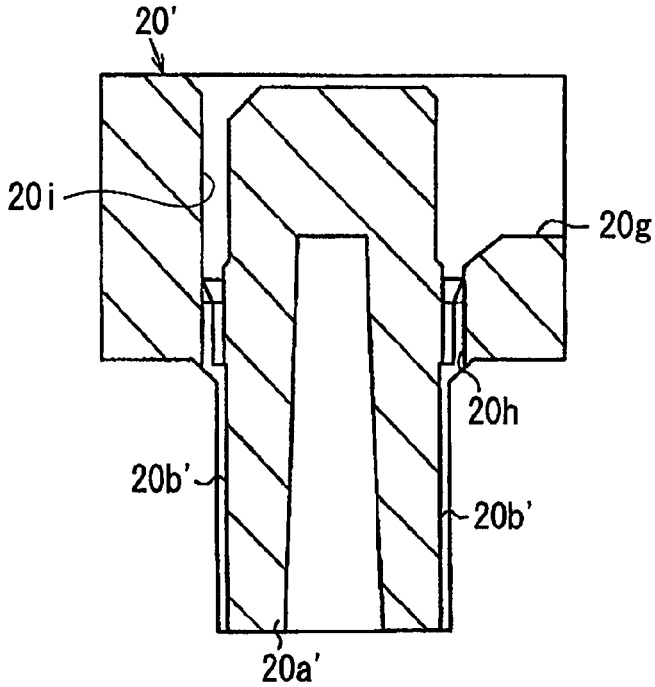
FIG. 8 is an enlarged cross-sectional view of a holder of the connector assembly of FIG. 5.

As shown in FIG. 8, each holder 20' has a connection convex portion 20*a*' which can be inserted into the connection concave portion 10*a*' of the receptacle 1'. A plurality of holding grooves 20*b*', which are for holding after-mentioned connection terminals 201', 211' of the connection member 21', are formed on both sides of the connection convex portion 20*a*' in the longitudinal direction thereof. Each holding groove 20*b*' formed in one surface of the connection convex portion 20*a*' (a surface near the opposite holder 20') is communicated with a slit-like concave portion 20*g* formed in the upper part of the holder 20' through a through hole 20*h*. Each holding groove 20*b*' formed in the other surface of the connection convex portion 20*a*' (a surface far from the opposite holder 20') is communicated with an upper surface of the holder 20' through a through hole 20*i*.

Figure 9:
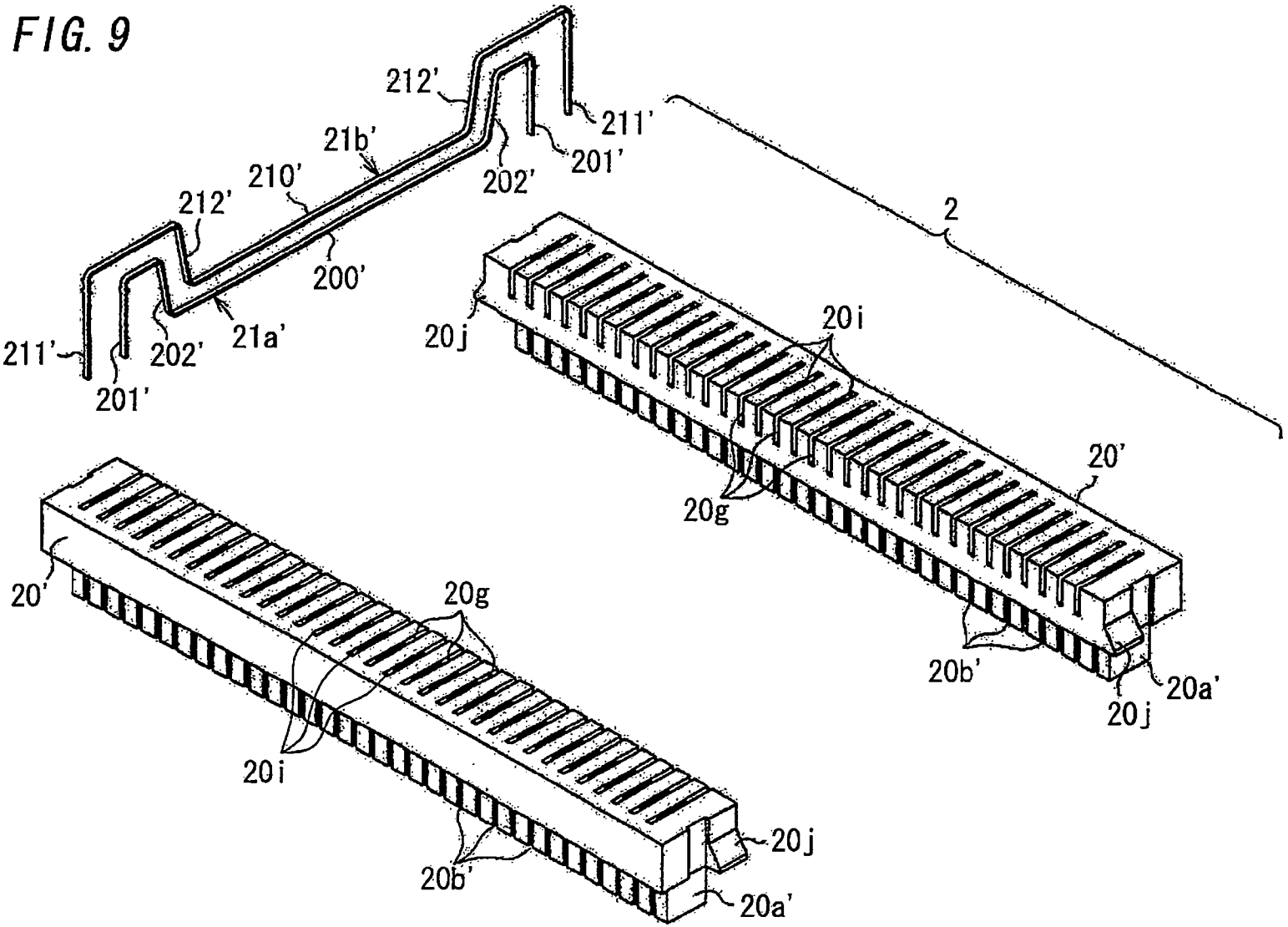
FIG. 9 is an exploded perspective view of an attachment member of the connector assembly of FIG. 5.

As shown in FIG. 9, protrusions 20*j* as second engagement parts for secure the cover 3 are formed on both longitudinal ends of each holder 20'. The upper surface of each protrusion 20*j* slops downward so as to attach the cover 3 smoothly.

As shown in FIGS. 6, 7, and 9, the connection members 21' comprise a plurality of first connection members 21*a*' and a plurality of second connection members 21*b*'. The first connection members 21*a*' are for connecting between the substrate terminals 11' arranged on a side of each housing 10' which is near the opposite housing 10' out of the substrate terminals 11' arranged on both sides of the housing 10', and the second connection members 21*b*' are for connecting between the substrate terminals 11' arranged on a side of each housing 10' which is far from the opposite housing 10' out of the substrate terminals 11' arranged on both sides of the housing 10'. Each first connection member 21*a*' has a link section 200' which is disposed between the pair of holders 20' and connection terminals 201' formed at both ends of the link section 200'. The connection terminals 201' are held by the holder 20' and come into contact with the substrate terminals 11' when the pair of holders 20' is coupled to the pair of receptacles 1'. In a similar way, each second connection member 21*b*' has a link section 210' which is disposed between the pair of holders 20' and connection terminals 211' formed at both ends of the link section 210'. The connection terminals 211' are also held by the holders 20' and come into contact with the substrate terminals 11' when the holders 20' are coupled to the receptacles 1'.

Each connection terminal 201' of the first connection member 21*a*'is linear, and it is disposed in one of the holding grooves 20*b*' of the holder 20'through the slit-like concave portion 20*g* and the through hole 20*h*. That is, the connection terminals 201' of the first connection members 21*a*' are disposed in the holding grooves 20*b*' on a side near the opposite holder 20'. Each connection terminal 211' of the second connection member 21*b*' is also linear and is disposed in one of the holding groove 20*b*' of the holder 20' through the through hole 20*i*. That is, the connection terminals 211' of the second connection members 21*b*' are disposed in the holding grooves 20*b*' on a side far from the opposite holder 20'.

As shown in FIG. 9, a midsection of the link section 200' of the first connection member 21*a*' is bent into a generally U-shaped configuration in the thickness direction of the printed circuit boards P1, P2, whereby a spring section 202' for allowing change of a distance between the connection terminals 201' is formed. In a similar way, a midsection of the link section 210' of the second connection member 21*b*' is bent into a generally U-shaped configuration in the thickness direction of the printed circuit boards P1, P2, whereby a spring section 212' for allowing a change of a distance between the connection terminals 211' is formed. That is, by elastic deformation of the spring sections 202' and 212', misalignment between the printed circuit boards P1, P2 and/or between the pair of receptacles 1 in the arranging direction of the two printed circuit boards can be absorbed.

When the first connection members 21*a*' and the second connection members 21*b*' are connected to the holders 20', the link section 200' of each of the first connection members 21*a*' is disposed nearer to the printed circuit boards P1, P2 than the link section 210' of each of the second connection member 21*b*' in the thickness direction of the printed circuit boards, as shown in FIG. 6. In other words, the link section 200' of each first connection member 21*a*' is disposed below the link section 210' of each second connection member 21*b*'. By disposing the link section 200' of each first connection member 21*a*' below the link section 210' of each second connection member 21*b*', the first connection member 21*a*' and the second connection member 21*b*' do not interfere with each other, whereby it is possible to arrange many connection members 21' along the longitudinal direction of the holder 20'.

Figure 10:
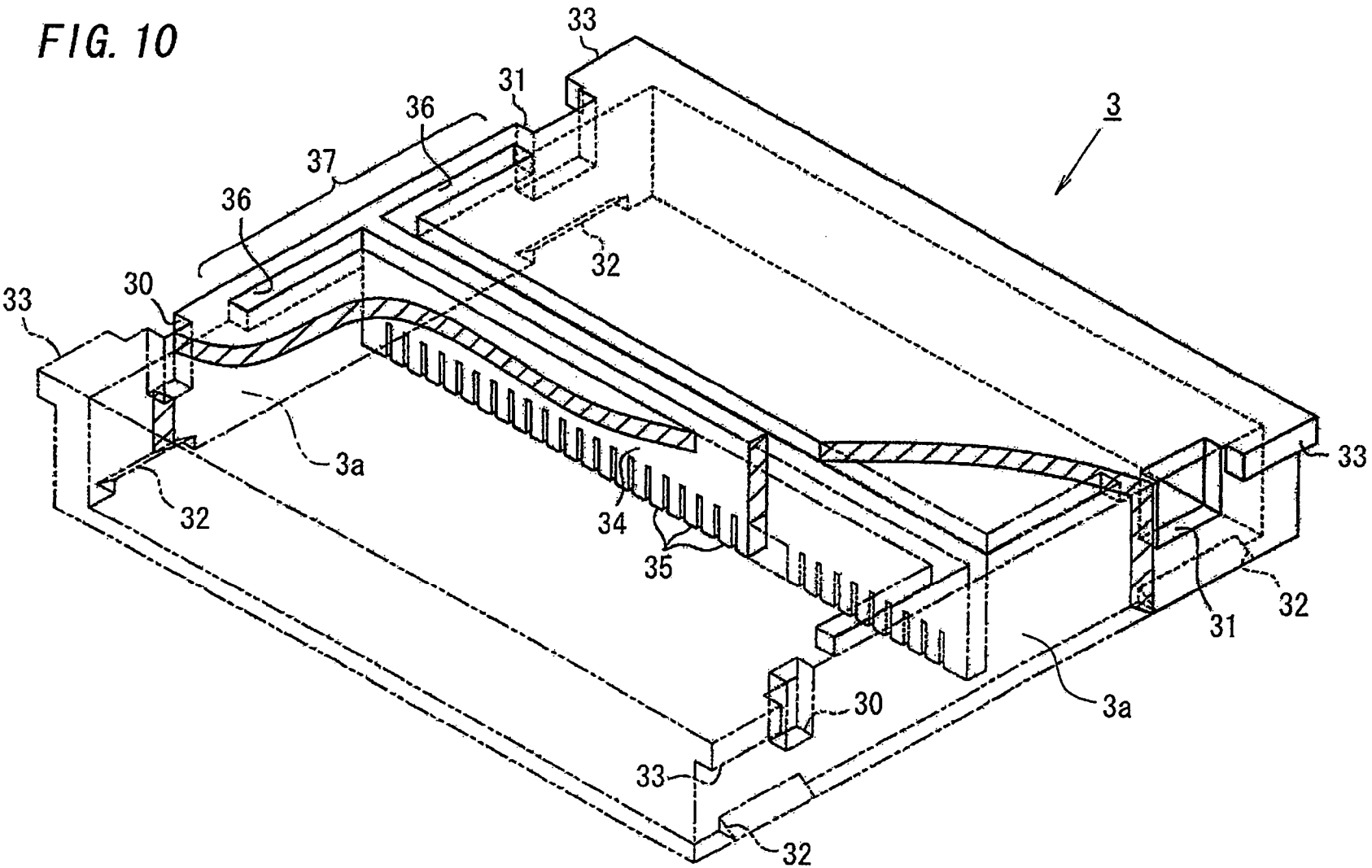
FIG. 10 is a partly cutaway perspective view of a cover of the connector assembly of FIG. 5.
Figure 14:
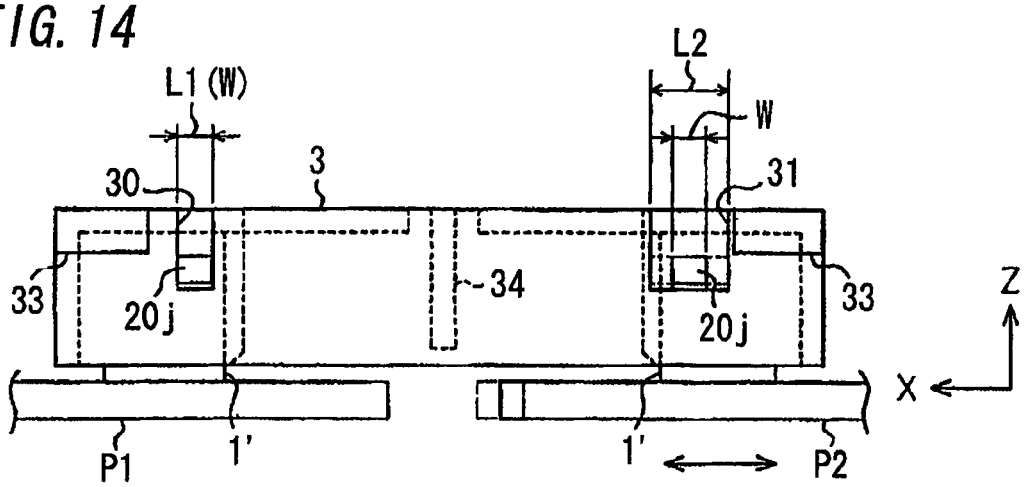
FIG. 14 is a side view of the connector assembly of FIG. 5.

As shown in FIG. 10, the cover 3 is made from a transparent or half-transparent insulating material and is molded into a box shape opened downward. A pair of openings 30 and a pair of openings 31 as a first engagement parts are formed in a pair of opposed side walls 3*a* of the cover 3. As shown in FIG. 14, each opening 30 and 31 are formed so that each protrusion 20*j* of the holders 20' as the second engagement part is disposed in each opening 30 and 31 when the cover 3 is attached to the holders 20'. The opening 30 has a width L1, which is slightly larger than a width W of the protrusion 20*j* of the holder 20', and the opening 31 has a width L2, which is sufficiently larger than the width W of the protrusion 20*j*.

As shown in FIG. 10, the lower end of the side wall 3*a* has oblique surfaces 32 which, respectively, slope inward under the opening 30 and the opening 31. The oblique surfaces 32 come in contact with edges of the upper surfaces of the holders 20' when the cover 3 is attached to the holders 20', whereby it becomes easy to position the cover 3 with respect to the holders 20'. Furthermore, by these oblique surfaces 32, it becomes easy for the side walls 3*a* of the cover 3 to climb over the protrusions 20*j* of the holders 20' when the cover 3 is attached to the holders 20'. Furthermore, at each corner of the upper surface of the cover 3, a holding protrusion 33 is formed for easier holding of the cover 3.

Figure 11:
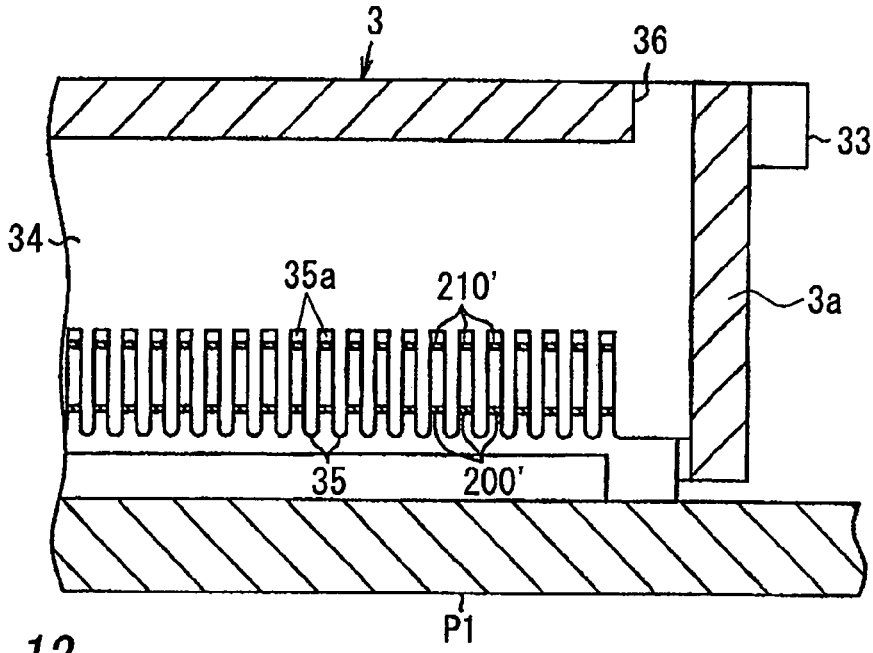
FIG. 11 is a view showing a separator of the connector assembly of FIG. 5.

As shown in FIG. 10, inside the cover 3, a vertical wall 34 is integrally molded with the cover 3 between the centers of the side walls 3*a*. A comb separator 35 which is disposed between each adjacent connection members 21' is formed at the lower end of the vertical wall 34 to separate between the adjacent connection members 21'. That is, as shown in FIG. 11, when the cover 3 is attached to the holders 20', each of the link sections 200' of the first connection members 21*a*' and each of the link sections 210' of the second connection members 21*b*' are disposed in a slit 35*a* formed between the separators 35 in a spaced relation to each other, and the link sections 200' of the adjacent first connection members 21*a*' and the link sections 210'of the adjacent second connection members 21*b*' are separated by the separator 35. By the separator 35, it is prevented that the adjacent connection members 21' come in contact with each other.

Furthermore, in the top board of the cover 3, generally U-shaped gaps 36 are formed at the both sides of the vertical wall 34. These gaps 36 define an elastic deformation part 37, which is capable of deforming elastically to allow displacement between the two printed circuit boards P1 and P2.

In the connector assembly of this embodiment constituted as above, in order to electrically connect between the two printed circuit boards P1 and P2 arranged side by side, first, each receptacle 1' is mounted on each printed circuit board P1, P2, and the connection convex portion 20*a*' of each holder 20' of the attachment member 2' is inserted into the connection concave portion 10*a*' of each housing 10'. By this, the contacts 11*b*' of the substrate terminals 11' of the receptacles 1' and the connection terminals 201' and 211' of the attachment member 2' are connected to each other.

Figure 12:
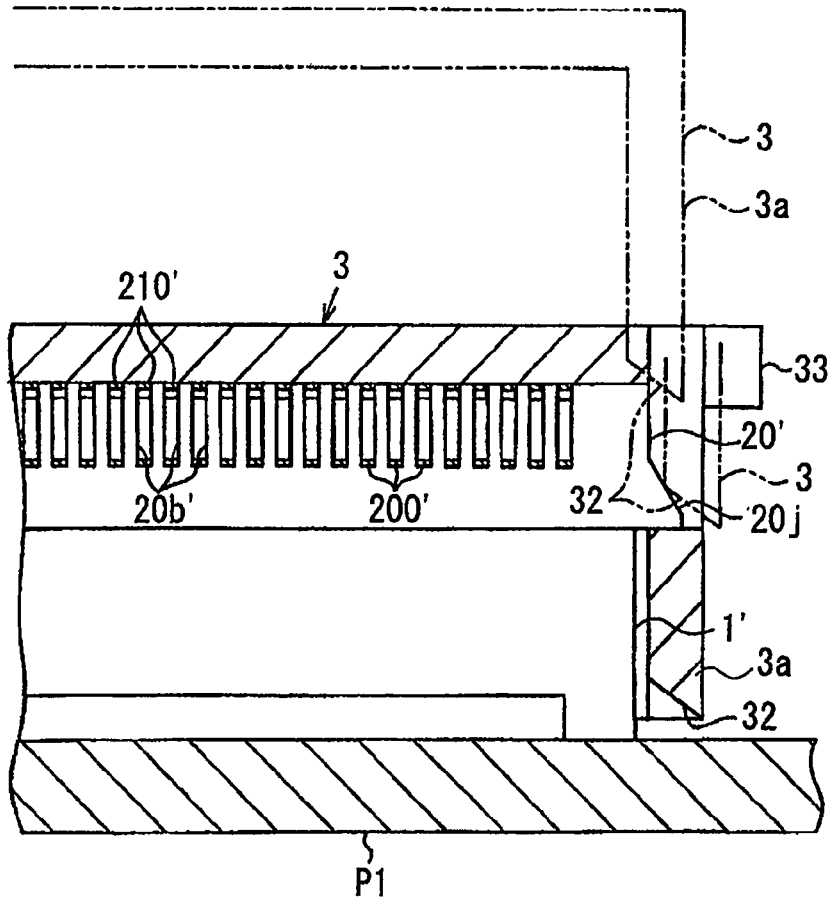
FIG. 12 is a view for explaining an attachment state of the cover of the connector assembly of FIG. 5.

Then, the cover 3 is attached to both the holders 20'. As shown in FIG. 12, when the cover 3 is attached to the holders 20', the oblique surfaces 32 formed at the lower end of the side walls 3*a* of the cover 3 come in contact with the edges of the upper surfaces of the holders 20', whereby misalignment between the cover 3 and the holders 20' is corrected. When the cover 3 is further pressed down from this state, the oblique surfaces 32 come into contact with the sloped upper surfaces of the protrusions 20*j* of the holders 20' as indicated by a chain double-dashed line in FIG. 12, whereby the side walls 3*a* of the cover 3 elastically deform outward. When the openings 30 and 31 of the cover 3 reach the protrusions 20*j* of the holders 20', the side walls 3*a* of the cover 3 return to the original state, and as indicated by a full line in FIG. 12, the openings 30 and 31 (that is, the first engagement parts) and the protrusions 20*j* (that is, the second engagement parts) are engaged with each other. At this time, the undersurface of the top board of the cover 3 comes in contact with the upper surfaces of the holders 20'. As a result, the cover 3 is fixed to the holders 20' in a condition where the cover 3 covers the connection members 21' and both receptacles 1'. By covering the connection members 21' and both receptacles 1' by the cover 3 as above, it is prevented that a user carelessly touches the connection members 21' or environmental dusts adhere to the connection members 21'. By this, it is possible to increase insulation properties of the connection members 21'.

When the cover 3 is detached from the receptacles 1', the attachment member 2' is also detached from the receptacles 1' with the cover 3. Because the attachment member 2' is detached from the receptacles 1' while maintaining the positional relation between the pair of holders 20', the first connection members 21*a*' and the second connection members 21*b*' are prevented from being strained, and the deformations of them are prevented.

Figure 15A:
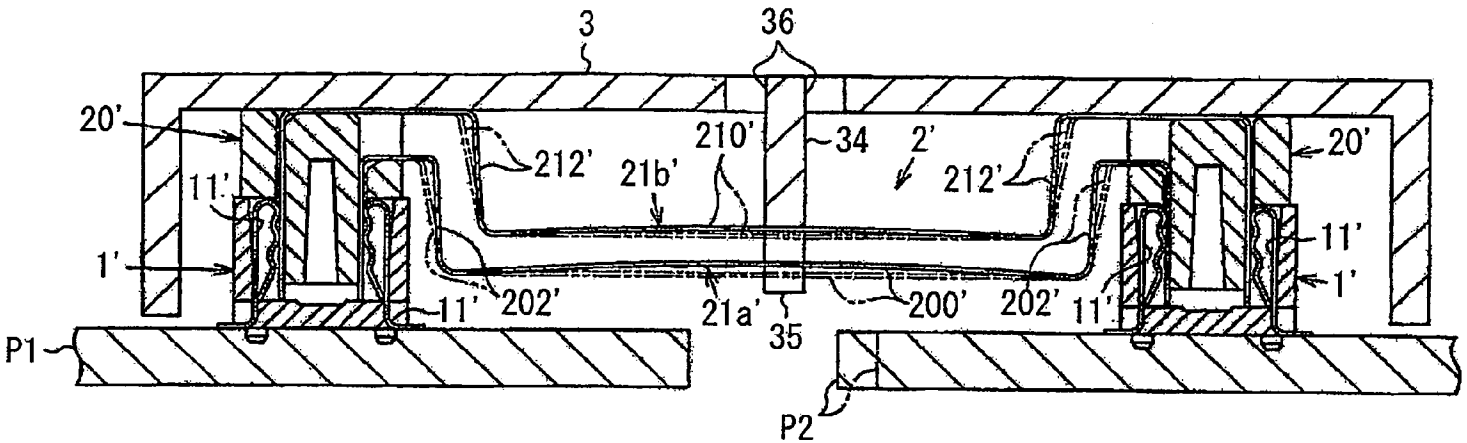
FIG. 15A is a view for explaining a deformation of a connection member of the connector assembly of FIG. 5.

By the way, it is also possible to attach the attachment member 2' to which the cover 3 has already attached, to the receptacles 1'. When the attachment member 2' is attached to the receptacles 1' with the cover 3, the positional relation between the printed circuit boards P1 and P2 may be shorter than predetermined positional relation between them in the X direction of FIG. 5, namely, in the arranging direction of the two printed circuit boards P1 and P2. In such a case, when the holders 20' of the attachment member 2' were attached to the receptacles 1', as shown in FIG. 15A, the degree of flexion of the spring sections 202' of the first connection members 21*a*' and the degree of flexion of the spring sections 212' of the second connection members 21*b*' are increased, and the link sections 200' and 210' are curved upward. By this, it is possible to attach each holder 20' to each receptacle 1' easily. Because, as shown in FIG. 14, the opening 31 of the cover 3 has the width L2 which is sufficiently larger than the width W of the protrusion 20*j*, even when the cover 3 is attached to the attachment member 2', the reduction of the distance between the pair of holders 20' (namely, approximation of the pair of holders 20') is allowed. By this, it is prevented that excessive force is added to the holders 20' coupled to the receptacles 1' by the cover 3.

Figure 15B:
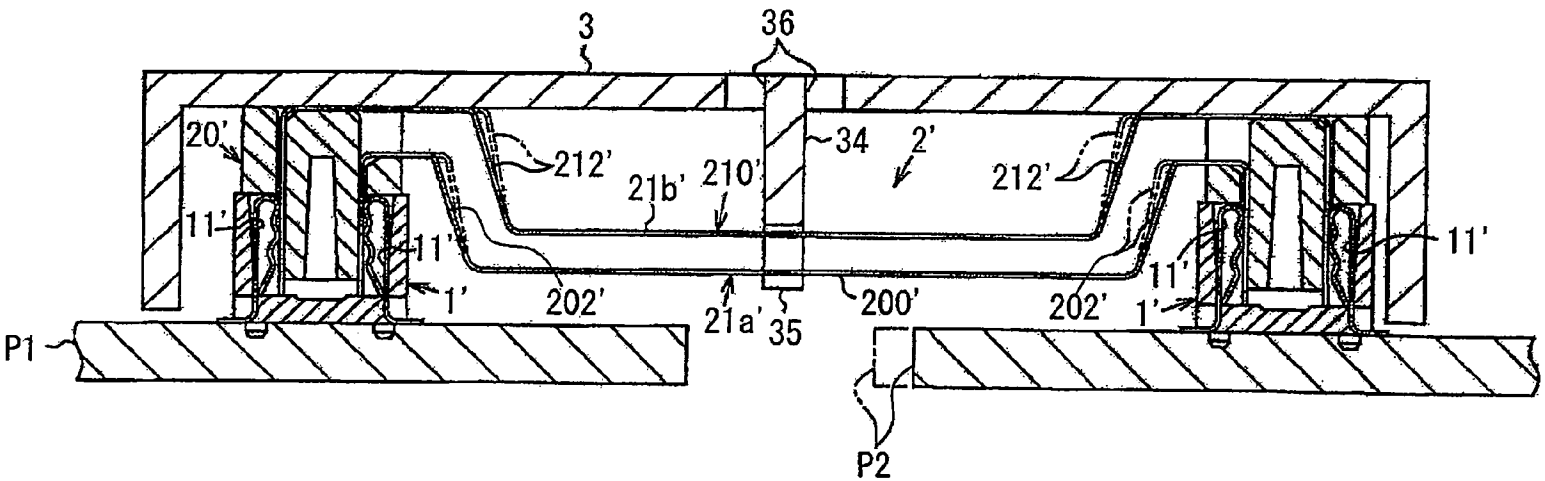
FIG. 15B is a view for explaining a deformation of the connection member of the connector assembly of FIG. 5.
Figure 16:
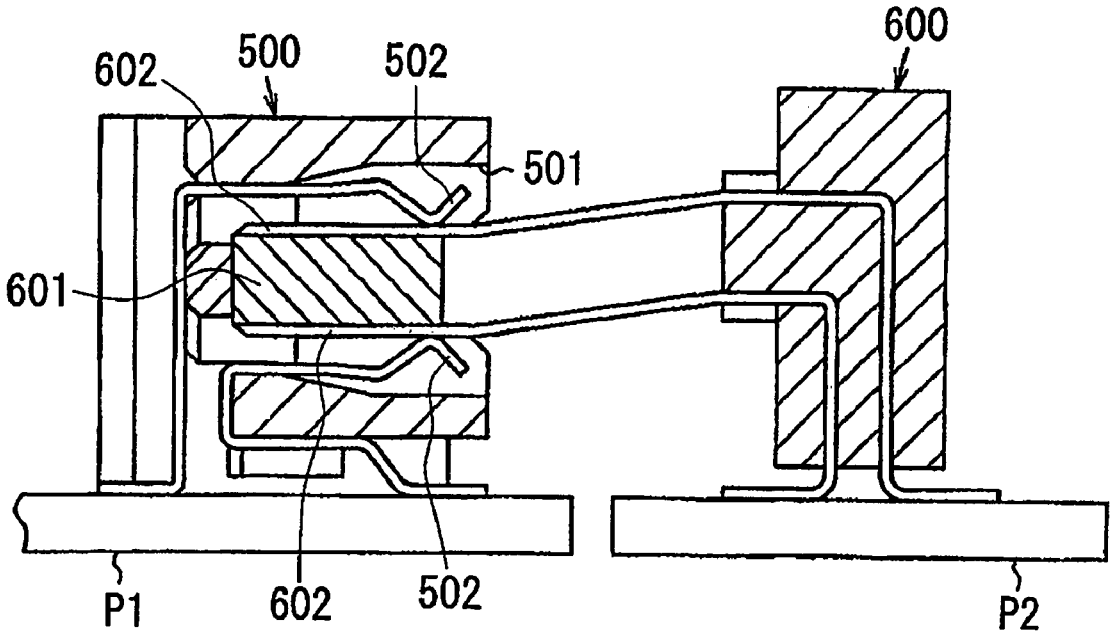
FIG. 16 is a cross-sectional view of a connector assembly of a prior art.

Or, when the attachment member 2' is attached to the receptacles 1' with the cover 3, the positional relation between the printed circuit boards P1 and P2 may be longer than predetermined positional relation between them in the X direction of FIG. 5. In such a case, when the holders 20' of the attachment member 2' were attached to the receptacles 1', as shown in FIG. 15B, the degree of flexion of the spring sections 202' of the first connection members 21*a*' and the degree of flexion of the spring sections 212' of the second connection members 21*b*' are decreased. By this, it is possible to attach each holder 20' to each receptacle 1' easily. In this case, too, because the opening 31 of the cover 3 has the width L2 which is sufficiently larger than the width W of the protrusion 20*j*, even when the cover 3 is attached to the attachment member 2', the increase of the distance between the two holders 20' is allowed.

Figure 13:
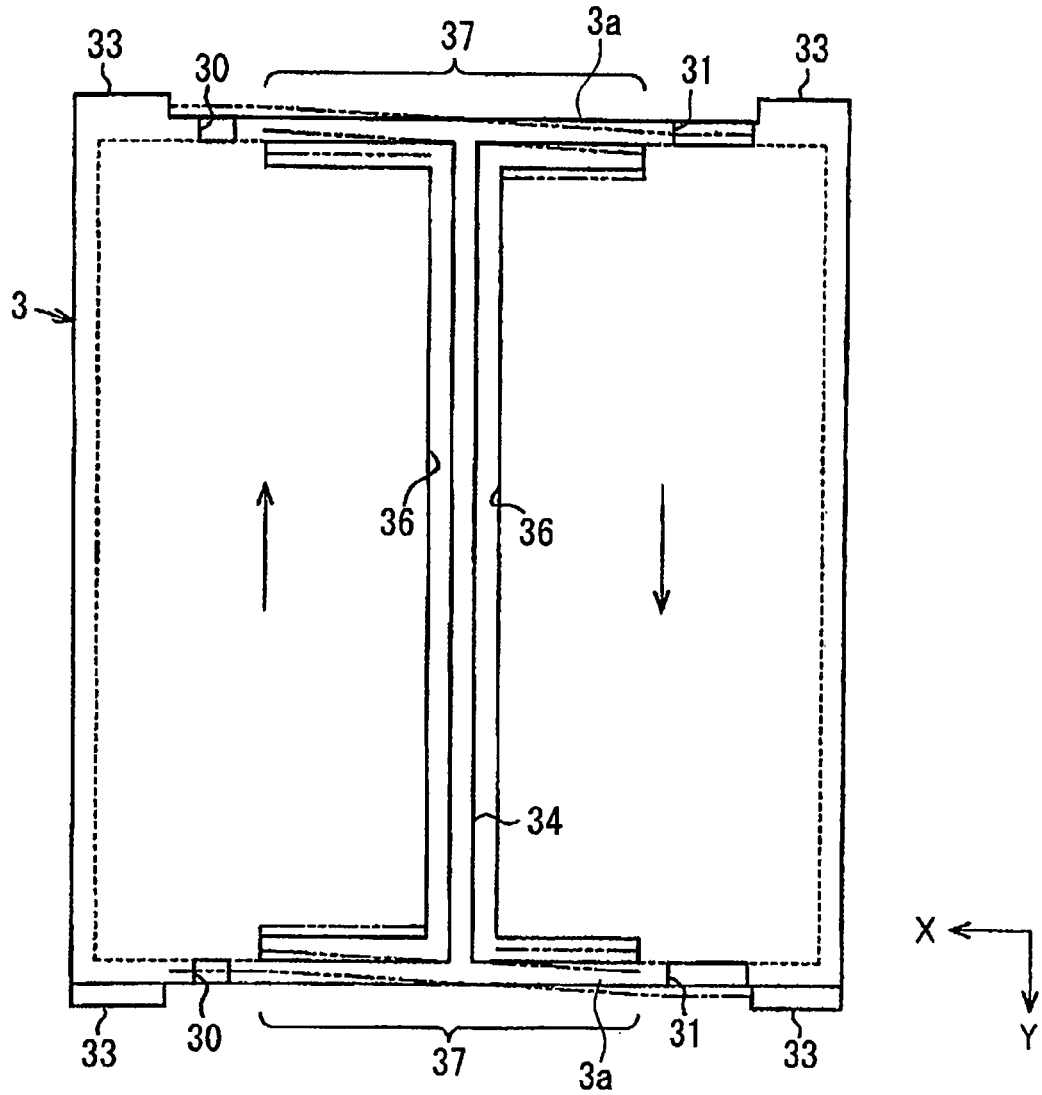
FIG. 13 is a view for explaining a deformation of the cover of the connector assembly of FIG. 5.

Or, when the attachment member 2' is attached to the receptacles 1' with the cover 3, the positional relation between the printed circuit boards P1, P2 may be misaligned from predetermined positional relation between them in the Y direction of FIG. 5, namely, in the direction perpendicular to the arranging direction of the two printed circuit boards P1 and P2. In such a case, as shown in FIG. 13, the elastic deformation part 37 of the cover 3 elastically deforms, whereby the misalignment of the both holders 20' is allowed. Because the adjacent connection members 21' are separated from each other by the comb separator 35, it is prevented that the adjacent connection members 21' come in contact with each other.

As mentioned above, in the connector assembly of this embodiment, it is possible to easily connect two printed circuit boards P1 and P2 arranged side by side to each other by inserting each holder 20' of the attachment member 2' into each receptacle 1' along the thickness direction of the printed circuit boards, even when the two printed circuit boards P1 and P2 are arranged on e.g. a case (not shown) side by side and are fixed thereto. Furthermore, it is possible to absorb misalignment between the printed circuit boards P1, P2 or between the pair of receptacles 1' by elastically deforming the spring sections 202' and 212' of the link sections 200' and 210' of the attachment member 2.

In addition, as a substitute for the protrusions 20*j* of the holders 20', the receptacles 1' may have similar protrusions, and the cover 3 may be attached to the pair of receptacles 1'.

The shape of the elastic deformation part 37 is not limited to the shape of the present invention.

The invention claimed is:

1. A connector assembly for electrical connection between two printed circuit boards arranged side by side, said connector assembly comprising:

a pair of receptacles configured to be mounted on each printed circuit board, respectively, an attachment member connected to said pair of receptacles so as to electrically connect between said pair of receptacles, wherein each of said receptacles comprises a housing made from an insulating material and configured to be fixed on one of said printed circuit boards, and a plurality of substrate terminals made from a conductive material and configured to be electrically connected to said printed circuit board, said plurality of substrate terminals being arranged on both sides of said housing in a direction perpendicular to an arranging direction of said two printed circuit boards, said attachment member comprising a pair of holders coupled to said pair of receptacles, and a plurality of connection members which connect between said pair of holders electrically, said plurality of connection members comprising first connection members and second connection members, each of said fist connection members and each of said second connection members having, respectively, a link section disposed between said pair of holders, and connection terminals formed at both ends of said link section and coming into contact with said substrate terminals of said receptacles when said pair of holders are coupled to said pair of receptacles, said first connection members connecting between said substrate terminals arranged on a side of each housing which is near the opposite housing out of said substrate terminals arranged on both sides of each housing, said second connection members connecting between said substrate terminals arranged on a side of each housing which is far from the opposite housing out of said substrate terminals arranged on both sides of each housing, said link section of each of said first connection members being disposed nearer to said printed circuit boards than said link section of each of said second connection members in a thickness direction of said printed circuit boards, wherein said attachment member further comprises a spacer which is made from an insulating material and separates said link section of each of said first connection members and said link section of each of said second connection members from each other, and wherein said spacer has injection grooves in which the link sections of either said first connection members or said second connection members are pressed and fixed, and slide grooves which are formed in a surface of the spacer opposite to said injection grooves and hold slidably the link sections of the other of the first connection members and the second connection members.

2. The connector assembly as set forth in claim 1, wherein said link section of each of said first connection members and said link section of each of said second connection members have, respectively, a spring section which is curved or bent in the thickness direction of the printed circuit boards and has elastic deformability for allowing change of a distance between said connection terminals.

3. The connector assembly as set forth in claim 1, wherein each of said holders has first holding grooves into which said connection terminals of said first connection members are pressed, and second holding grooves into which said connection terminals of said second connection members are pressed, said first holding groove being opened in a common direction between said pair of holders, said second holding grooves being opened in a direction in which said holders are removed from said receptacles.

4. A connector assembly for electrical connection between two printed circuit boards arranged side by side, said connector assembly comprising:

a pair of receptacles configured to be mounted on each printed circuit board, respectively, an attachment member connected to said pair of receptacles so as to electrically connect between said pair of receptacles, wherein each of said receptacles comprises a housing made from an insulating material and configured to be fixed on one of said printed circuit boards, and a plurality of substrate terminals made from a conductive material and configured to be electrically connected to said printed circuit board, said plurality of substrate terminals being arranged on both sides of said housing in a direction perpendicular to an arranging direction of said two printed circuit boards, said attachment member comprising a pair of holders coupled to said pair of receptacles, and a plurality of connection members which connect between said pair of holders electrically, said plurality of connection members comprising first connection members and second connection members, each of said fist connection members and each of said second connection members having, respectively, a link section disposed between said pair of holders, and connection terminals formed at both ends of said link section and coming into contact with said substrate terminals of said receptacles when said pair of holders are coupled to said pair of receptacles, said first connection members connecting between said substrate terminals arranged on a side of each housing which is near the opposite housing out of said substrate terminals arranged on both sides of each housing, said second connection members connecting between said substrate terminals arranged on a side of each housing which is far from the opposite housing out of said substrate terminals arranged on both sides of each housing, said link section of each of said first connection members being disposed nearer to said printed circuit boards than said link section of each of said second connection members in a thickness direction of said printed circuit boards, wherein the connector assembly further comprises a cover which is made from an insulating material and is fixed to said pair of receptacles or said pair of holders so as to cover said connection members, and wherein said cover has a separator which is integrally molded with said cover and is disposed between adjacent connection members to separate therebetween.

5. A connector assembly for electrical connection between two printed circuit boards arranged side by side, said connector assembly comprising:

a pair of receptacles configured to be mounted on each printed circuit board, Respectively, an attachment member connected to said pair of receptacles so as to electrically connect between said pair of receptacles, wherein each of said receptacles comprises a housing made from an insulating material and configured to be fixed on one of said printed circuit boards, and a plurality of substrate terminals made from a conductive material and configured to be electrically connected to said printed circuit board, said plurality of substrate terminals being arranged on both sides of said housing in a direction perpendicular to an arranging direction of said two printed circuit boards, said attachment member comprising a pair of holders coupled to said pair of receptacles, and a plurality of connection members which connect between said pair of holders electrically, said plurality of connection members comprising first connection members and second connection members, each of said fist connection members and each of said second connection members having, respectively, a link section disposed between said pair of holders, and connection terminals formed at both ends of said link section and coming into contact with said substrate terminals of said receptacles when said pair of holders are coupled to said pair of receptacles, said first connection members connecting between said substrate terminals arranged on a side of each housing which is near the opposite housing out of said substrate terminals arranged on both sides of each housing, said second connection members connecting between said substrate terminals arranged on a side of each housing which is far from the opposite housing out of said substrate terminals arranged on both sides of each housing, said link section of each of said first connection members being disposed nearer to said printed circuit boards than said link section of each of said second connection members in a thickness direction of said printed circuit boards, wherein the connector assembly further comprises a cover which is made from an insulating material and is fixed to said pair of receptacles or said pair of holders so as to cover said connection members, and wherein said cover has first engagement vans and each of said holders has a second engagement part, said cover being fixed to each of said holders by engaging said first engagement parts with said second engagement part of each of said holders, and wherein each of said first engagement parts is an opening formed in a side wall of said cover, said second engagement part being a protrusion formed on a side surface of each of said holders, said protrusion being configured to be disposed in said opening and said opening having a width larger than a width of said protrusion.

6. A connector assembly for electrical connection between two printed circuit boards arranged side by side, said connector assembly comprising:

a pair of receptacles configured to be mounted on each printed circuit board, respectively, an attachment member connected to said pair of receptacles so as to electrically connect between said pair of receptacles, wherein each of said receptacles comprises a housing made from an insulating material and configured to be fixed on one of said printed circuit boards, and a plurality of substrate terminals made from a conductive material and configured to be electrically connected to said printed circuit board, said plurality of substrate terminals being arranged on both sides of said housing in a direction perpendicular to an arranging direction of said two printed circuit boards, said attachment member comprising a pair of holders coupled to said pair of receptacles, and a plurality of connection members which connect between said pair of holders electrically, said plurality of connection members comprising first connection members and second connection members, each of said fist connection members and each of said second connection members having, respectively, a link section disposed between said pair of holders, and connection terminals formed at both ends of said link section and coming into contact with said substrate terminals of said receptacles when said pair of holders are coupled to said pair of receptacles, said first connection members connecting between said substrate terminals arranged on a side of each housing which is near the opposite housing out of said substrate terminals arranged on both sides of each housing, said second connection members connecting between said substrate terminals arranged on a side of each housing which is far from the opposite housing out of said substrate terminals arranged on both sides of each housing, said link section of each of said first connection members being disposed nearer to said printed circuit boards than said link section of each of said second connection members in a thickness direction of said printed circuit boards, wherein the connector assembly further comprises a cover which is made from an insulating material and is fixed to said pair of receptacles or said pair of holders so as to cover said connection members, and wherein said cover has an elastic deformation part capable of deforming elastically to allow displacement between the two printed circuit boards.

* * * * *